US008616334B2

(12) United States Patent
Allred et al.

(10) Patent No.: US 8,616,334 B2
(45) Date of Patent: Dec. 31, 2013

(54) APPARATUS, SYSTEM, AND METHOD FOR LADDER STEP PREVENTION DEVICE

(76) Inventors: Larry D. Allred, West Jordan, UT (US); Larry B. Allred, West Jordan, UT (US)

( * ) Notice: Subject to any disclaimer, the term of this patent is extended or adjusted under 35 U.S.C. 154(b) by 653 days.

(21) Appl. No.: 12/177,808

(22) Filed: Jul. 22, 2008

(65) Prior Publication Data

US 2010/0018801 A1 Jan. 28, 2010

(51) Int. Cl.
*E06C 7/18* (2006.01)

(52) U.S. Cl.
USPC ..... 182/106; 182/129; 182/165

(58) Field of Classification Search
USPC ..... 182/129, 165, 106
See application file for complete search history.

(56) References Cited

U.S. PATENT DOCUMENTS

| | | | | | |
|---|---|---|---|---|---|
| 2,585,150 | A * | 2/1952 | McGill | 182/120 |
| 3,311,195 | A * | 3/1967 | Singer | 182/230 |
| 3,372,772 | A * | 3/1968 | Singer | 182/230 |
| 3,968,857 | A * | 7/1976 | Bryan | 182/106 |
| 4,418,792 | A * | 12/1983 | Cerone | 182/93 |
| 4,450,935 | A * | 5/1984 | Gustavus | 182/45 |
| 4,450,937 | A * | 5/1984 | Broughton | 182/206 |
| 4,524,848 | A * | 6/1985 | Russo | 182/77 |
| 4,579,197 | A * | 4/1986 | Spurling | 182/106 |
| 4,726,446 | A * | 2/1988 | Perbix | 182/46 |
| 4,949,811 | A * | 8/1990 | Bailey | 182/220 |
| 4,991,691 | A * | 2/1991 | Brawer et al. | 182/106 |
| D317,206 | S * | 5/1991 | Cagle | D25/68 |
| 5,039,159 | A * | 8/1991 | Bonner | 296/136.01 |
| 5,343,977 | A * | 9/1994 | Bryan | 182/106 |
| 5,441,126 | A * | 8/1995 | Orrick | 182/106 |
| 5,647,453 | A * | 7/1997 | Cassells | 182/129 |
| 5,832,755 | A * | 11/1998 | Crilly | 70/58 |
| 5,988,383 | A * | 11/1999 | Armstrong | 206/373 |
| 6,012,689 | A | 1/2000 | Sisca | |
| 6,241,204 | B1 * | 6/2001 | Bermes | 248/210 |
| 6,334,509 | B1 * | 1/2002 | Ryszkiewicz | 182/129 |
| 6,364,057 | B1 * | 4/2002 | Cornejo et al. | 182/106 |
| 6,450,337 | B1 * | 9/2002 | Campagna et al. | 206/373 |
| 6,766,990 | B1 * | 7/2004 | Hileman et al. | 248/210 |
| 7,156,205 | B2 | 1/2007 | Wilson et al. | |
| 7,168,759 | B2 * | 1/2007 | Gallegos Geier | 297/184.1 |
| 7,370,726 | B1 * | 5/2008 | Chavez | 182/129 |
| 7,500,645 | B1 * | 3/2009 | McCubbins | 248/210 |
| 7,717,231 | B2 * | 5/2010 | Horton | 182/106 |
| D616,929 | S * | 6/2010 | Krivanek et al. | D19/1 |
| 2002/0153202 | A1 * | 10/2002 | Sawicki et al. | 182/129 |
| 2003/0015371 | A1 * | 1/2003 | Coore | 182/129 |
| 2004/0069569 | A1 * | 4/2004 | Fraser | 182/129 |
| 2005/0241199 | A1 * | 11/2005 | Ghormley | 40/617 |

(Continued)

FOREIGN PATENT DOCUMENTS

| | | | | |
|---|---|---|---|---|
| FR | 2695040 | A1 * | 3/1994 | A63B 29/04 |

*Primary Examiner* — Katherine Mitchell
*Assistant Examiner* — Candace L Bradford
(74) *Attorney, Agent, or Firm* — Kunzler Law Group

(57) ABSTRACT

An apparatus, system, and method are disclosed to prevent a user from using the top step of a ladder. The apparatus comprises a substantially solid front face on which a first side flap and second side flap are disposed. The first and second side flaps are disposed at an angle to the front face in order to create a spring force when inserted in a "C" shaped cross section of a ladder. The apparatus is held to a ladder through the spring force and by securing the side flaps and front face to the ladder legs.

16 Claims, 14 Drawing Sheets

(56) References Cited

U.S. PATENT DOCUMENTS

2006/0076188 A1* 4/2006 Horton ..... 182/106
2006/0266811 A1* 11/2006 Clegg et al. ..... 229/116.1
2009/0114479 A1* 5/2009 Tate ..... 182/230
2010/0025150 A1* 2/2010 White ..... 182/106
2010/0170749 A1* 7/2010 Leung ..... 182/129
2012/0298448 A1* 11/2012 Houdyshell ..... 182/106

* cited by examiner (B-B)

B-B

A-A

A-A

APPARATUS, SYSTEM, AND METHOD FOR LADDER STEP PREVENTION DEVICE

BACKGROUND OF THE INVENTION

1. Field of the Invention

This invention relates to ladder step prevention and more particularly relates to preventing a ladder user from standing on the first step of the ladder below the top of the ladder.

2. Description of the Related Art

Each year many people are injured from falls and other accidents associated with ladders. Ladder accidents constitute a large portion of on-the-job deaths and accidents. Because of these accidents, injuries and deaths, several government regulatory agencies have written stringent regulations concerning ladder construction and safety. These agencies include the U.S. Department of Labor Occupational Safety and Health Administration (OSHA) and the American National Standards Institute (ANSI). In addition to these national regulatory agencies, many state and local government regulations have been set. Labor unions and individual companies have also set their own particular rules and regulations in addition to government regulations. Ladder regulations include maximum load regulations, grip construction for ladder steps, maximum and minimum distance for ladder step placement, maximum measurements for the distance between side rails, slip resistant coatings requirements, and many other requirements.

A regulation that is seen in almost all ladder regulations is that a ladder user may not stand on the top of a ladder or stand on the first step below the top of a ladder ("first step"). Many ladder manufacturers place warning stickers on their ladders to deter users from using the top of the ladder or the first step of a ladder as a step. Even in these cases, users continue to use these areas as steps and accidents resulting from the use of the top of the ladder and the top step continue to occur.

In addition to warning stickers, government regulations, and company policies, attempts have been made to insure that user's do not step on the top step of a ladder or the first step of a ladder. These attempts involve cumbersome attachments, bulky apparatuses, a multiplicity of parts, weak connections, and other problems. These attempts are often ignored by ladder user's and do not prevent user's from endangering themselves by using the top of the ladder and the first step of the ladder as a step.

A simple apparatus that prevents a user from standing on the first step of a ladder is needed.

SUMMARY OF THE INVENTION

From the foregoing discussion, it should be apparent that a need exists for an apparatus, system, and method that prevent a ladder user from standing on the first step of the ladder below the top of the ladder. Beneficially, such an apparatus, system, and method would be free of protruding parts and burs, easy to store while attached to the ladder, free of cumbersome and bulky attachments, and easy to secure to the ladder.

The present invention has been developed in response to the present state of the art, and in particular, in response to the problems and needs in the art that have not yet been fully solved by currently available ladder step prevention methods. Accordingly, the present invention has been developed to provide an apparatus, system, and method for preventing a ladder user from standing on the first step of a ladder, that overcome many or all of the above-discussed shortcomings in the art.

The apparatus includes a front face that substantially fills the area between a ladder top, a first step, a left leg and a right leg of a ladder. The front face is substantially solid to prevent a user from stepping on the first step. The ladder legs are "C" shaped with the open center portion of the "C" shape facing the center of the ladder. The apparatus fits in the "C" shape of the ladder legs.

The apparatus also includes a first side flap and a second side flap. The first side flap and second side flap ("side flaps") are integrally connected with the front face. The side flaps are situated on the lateral ends of the front face with the first side flap on the opposite lateral end from the second side flap. The side flaps are angled with respect to the front face to create a spring force when inserted in the ladder. The side flaps are sized to fit in the open center portion of the "C" shaped ladder legs. When the apparatus is inserted into the ladder, the side flaps press in an outward direction on the open center portion of the "C" shaped cross section and secure within the open center portion.

The side flaps may extend the full length of the front face or there may be many side flaps. The side flaps may also be shaped differently in different embodiments. The side flaps have an angled bottom edge that allows the side flaps to fit over the top surface of the first step.

There may also be openings in the front face and side flaps. The openings may be used to fasten the front face and side flaps to a ladder through corresponding openings in the ladder. There may also be a tamper evident locking mechanism. There may also be handholds in the front face.

The front face and side flaps can be constructed from plastic, fiberglass, lexan, canvas or several other materials. The front face and side flaps may be constructed as a single, substantially flat material or with the side flaps pre-formed at an angle to the front face.

The front face may also have an access panel that opens to a compartment situated on the back of the front face. The access panel is flush with the front face and prevents the compartment from being used as a step.

A system of the present invention is also presented to limit access to the first step. The system may include a ladder with the apparatus positioned between the first step, the ladder top, the right leg and the left leg.

A method of the present invention is also presented for preventing access to the first step. The method may include placing a ladder in the upright position and securing the apparatus in the substantially "C" shaped cross section of the ladder legs. The apparatus is secured by pressing a lateral end of the front face inside the open center portion of the substantially "C" shaped cross section and then pressing the opposite lateral side of the front face into the open center portion of the substantially "C" shaped cross section. The side flaps flex against the legs of the ladder and snap into place as the side flaps pass the rear edge of the substantially "C" shaped cross section.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagram included herein is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
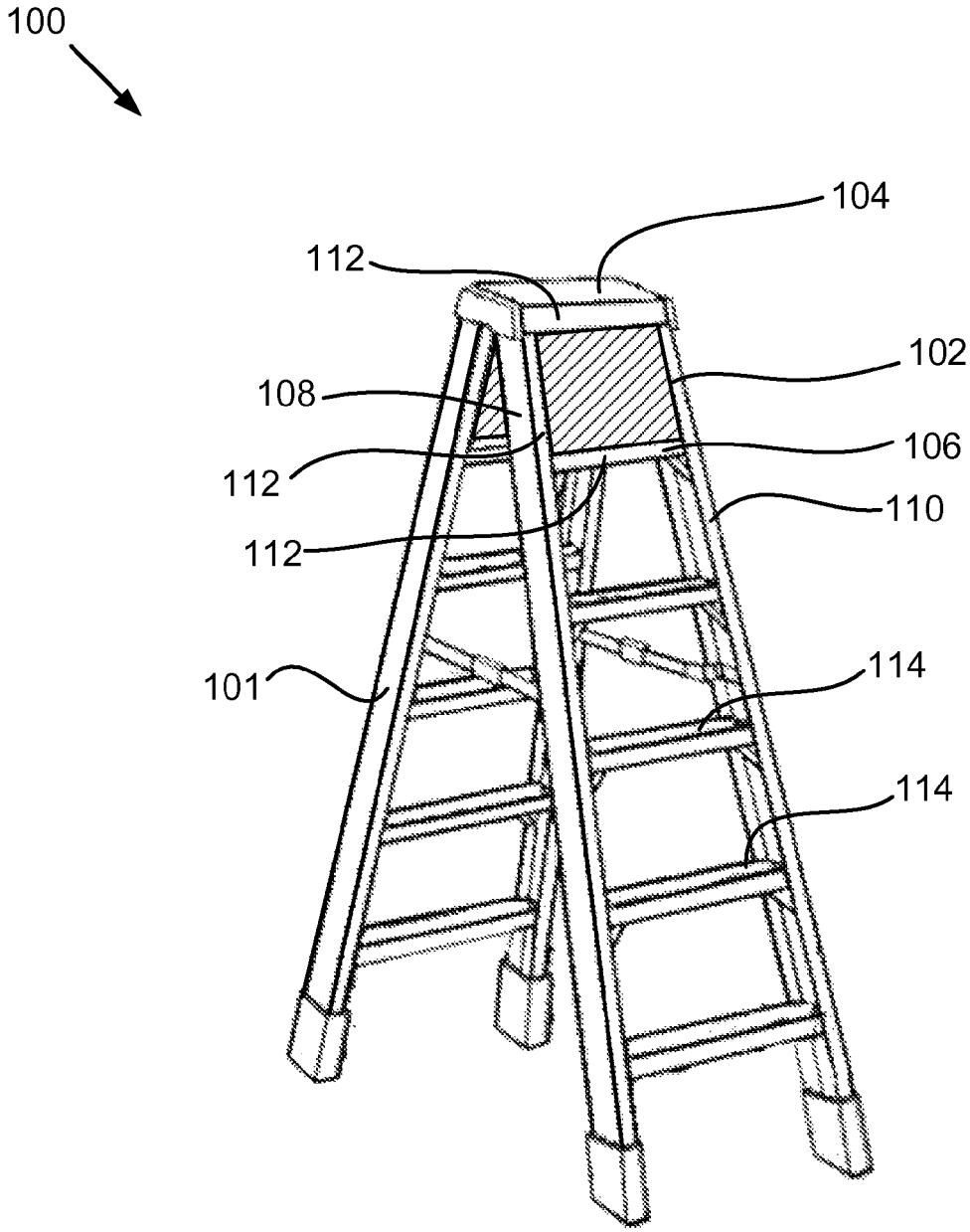
FIG. 1 is a perspective view illustrating one embodiment of a ladder step prevention device in accordance with the present invention.

FIG. 1 includes a ladder step prevention device 100 with a front face 102 that substantially fills an area between a ladder top 104 of a ladder 101, a first step 106 of the ladder 101, a left leg 108 of the ladder 101 and a right leg 110 of the ladder 101. The first step 106 of the ladder 101 is defined as the first step below the ladder top 104 of the ladder 101. For convenience, each successive step below the first step 106 is named by the corresponding, successive number. The left leg 108 and the right leg 110 are typically configured with a substantially "C" shaped cross section. An open center portion of the "C" shape faces a center of the ladder 101. The front face 102 is substantially solid to prevent a ladder user from stepping on the first step 106 or the ladder top 104. Preferably, the substantially solid front face 102 does not have moving parts, attachment straps, ties or cords that could catch on the user's clothing or person.

Typically, the front face 102 of the ladder step prevention device 100 is substantially flush with the face 112 of the ladder. This prevents the user from stepping on the first step 106 in front of the ladder step prevention device 100. This also helps to prevent the user from catching clothing or the user's person on an edge of the front face 102. However, the front face 102 may be recessed slightly or may protrude slightly. Many ladder regulations require that each ladder 101 is designed without sharp edges or burrs. Regulations also require that a ladder 101 is checked for sharp edges and burrs before each use. Designing the front face 102 of the ladder step prevention device 100 as a solid piece that is substantially flush with the face 112 of the ladder 101, without sharp edges or protruding attachments will help the ladder step prevention device 100 to comply with these regulations.

The ladder step prevention device 100 is designed to prevent a ladder user from stepping on the first step 106 of the ladder by positioning the front face 102 of the ladder step prevention device 100 substantially flush with a face 112 of the ladder 101. As a result, the top surface 114 of the first step 106 is not available to the user through the face 112 of the ladder 101 because it is covered by the front face 102 of the ladder step prevention device 100. The front face 102 extends horizontally and vertically so that there are no gaps or very small gaps between the front face 102 and the ladder top 104, the first step 106, the left leg 108 and the right leg 110.

Typically, when a user climbs a ladder 101, the user faces the face 112 of the ladder 101 and grasps a right leg 110 and the left leg 108 of the ladder 101 with the user's hands. The user steps on each successive step of the ladder 101 as the user ascends the ladder 101. When the user reaches the first step 106 the user is unable to step on the top surface 114 of the first step 106 because of the positioning of the ladder step prevention device 100. Because the user cannot use the first step 106, the user is unable to reasonably continue stepping on each successive ladder steps to reach the ladder top 104 of the ladder. In this way, the ladder step prevention device 100 typically prevents the user from using the first step 106 and the ladder top 104.

The ladder step prevention device 100 is configured to leave the ladder top 104 uncovered so that the ladder top 104 can be used as a stabilizing device by the user. In the case that the user loses balance near the ladder top 104, the user may be able to grasp around the ladder step prevention device 100 to secure the user's hands on the ladder. The ladder step prevention device 100 is also configured to leave the ladder top 104 uncovered so that the user may place objects on the ladder top 104.

The ladder step prevention device 100 can also make the ladder 101 more comfortable to use for the user. For example, a user can lean against the ladder step prevention device 100 to support the user's body while the user is standing on the ladder 101. This typically increases the user's comfort and stability while using the ladder 101. The user's body may rest against the ladder step prevention device 100 while the user is standing on lower steps of the ladder 101. The user's shins may rest against the ladder step prevention device 100 while the user is standing on the second or third step of the ladder 101. The front face 102 of the ladder step prevention device is typically a more comfortable resting position for the user than the edges of the ladder steps.

As the user leans against the ladder step prevention device 100, the stability of the user may increase. The user contacts more of the ladder 101 through the ladder step prevention device 100 to support and steady the user. In the case of a user who is working with both hands away from the ladder 101, increased contact with the ladder 101 through the ladder step prevention device 100 may be crucial to overall ladder stability.

Under one embodiment, the front face 102 of the ladder step prevention device 100 contains a warning printed on the front face 102. The warning may instruct the user that the first step 106 of the ladder is not able to be used as a step. Under other embodiments, the front face 102 may contain any writing, coloring, etching, raised drawing, raised lettering, symbol, or some other surface treatment. Under one embodiment, the front face 102 is colored to help alert the user that the ladder step prevention device 100 has been installed in the ladder.

Under the embodiment of FIG. 1, the ladder 101 has steps to the ladder top 104 from two sides of the ladder 101. To prevent the user from using either first step 106, two ladder step prevention devices 100 are placed on the ladder 101. One ladder step prevention device is disposed on one side of the ladder 101 between the first step 106, the ladder top 104, the right leg 110, and the left leg 108 while another ladder step prevention device 100 is situated on the other side of the ladder 101 between the first step 106, the ladder top 104, the right leg 110, and the left leg 108. Under other embodiments, one ladder step prevention device 100 is situated in the ladder 101.

Under one embodiment, the ladder step prevention device 100 is placed in an area between the right leg 110, the left leg 108 and other successive steps of the ladder besides the first step 106 and the ladder top 104. Due to the shape of the front face 102 of the ladder step prevention device 100, the ladder step prevention device 100 typically fits in other areas of the ladder besides the area between the right leg 110, the left leg 108, the ladder top 104 and the first step 106. In this way, the ladder step prevention device 100 can be used to restrict users from using steps that are below the first step 106.

Figure 2:
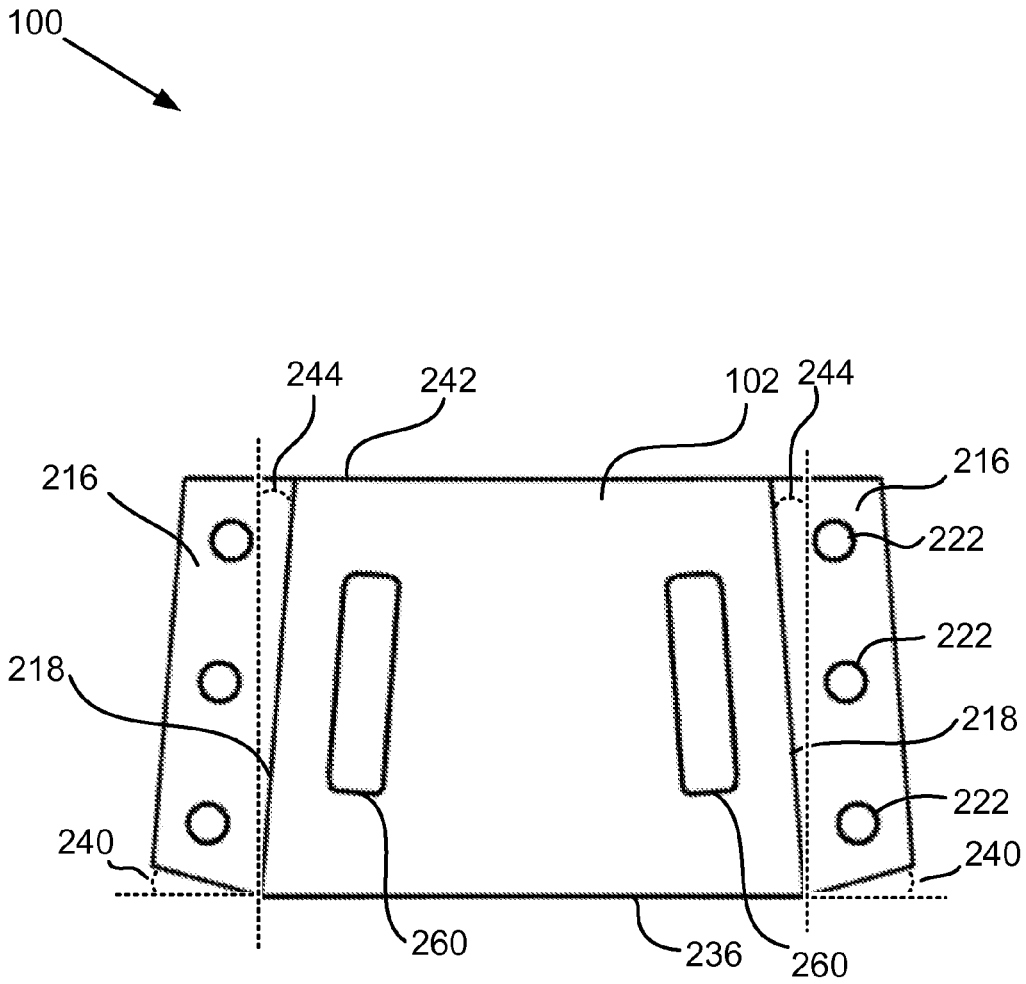
FIG. 2 is a front view illustrating one embodiment of a ladder step prevention device in accordance with the present invention.

Under the embodiment of FIG. 2, the ladder step prevention device 100 comprises a front face 102 that is integrally connected with a first side flap and a second side flap ("side flaps 216") disposed on the lateral sides 218 of the front face 102. Under this embodiment, the first side flap is disposed on the lateral sides 218 of the front face 102 opposite the second side flap. The ladder step prevention device 100 includes a small number of simple parts in order that it is easy to install and maintain. The ladder step prevention device 100 includes a small number of simple parts also to insure that the ladder step prevention device 100 is free of bulky attachments or protruding parts that could catch on clothing of the user.

Under this embodiment, the front face 102 is trapezoidal in shape and is configured to fit between the left leg 108, the right leg 110, the ladder top 104 and the first step 106 on many ladders. A top edge 242 of the front face 102 is shorter than a bottom edge 236 of the front face 102. The lateral sides 218 of the front face 102 create a lateral side angle 244 to vertical. The lateral side angle 244 allows the ladder step prevention device to fit in many ladders with variations in the spacing and angle of the ladder legs.

The angle at which the legs of a ladder are disposed varies in different types of ladders. The ladder step prevention device 100 accounts for this variation by disposing the lateral sides 218 of the front face 102 at an angle so that the top edge 242 of the front face 102 is at least slightly smaller than the bottom edge 236 of the front face.

Figure 3:
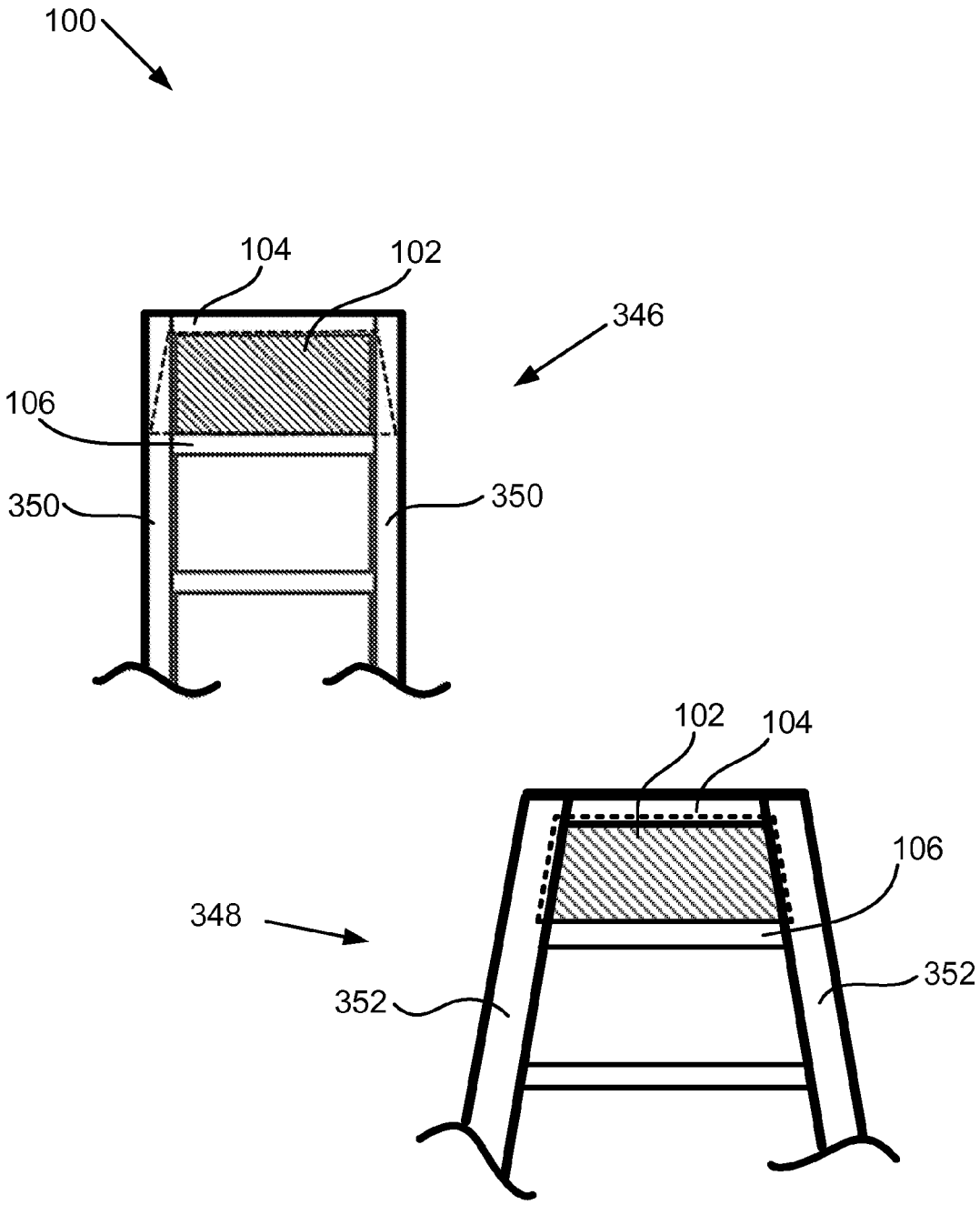
FIG. 3 is a front view illustrating one embodiment of a ladder step prevention device in accordance with the present invention.

FIG. 3 shows how the trapezoidal shape of the front face 102 fits within a ladder 346 with straight legs as well as a ladder 348 with angled legs. The ladder 346 contains straight ladder legs 350 that are not angled with respect to vertical. The ladder 348 contains angled ladder legs 352 that are angled with respect to vertical. Due to the trapezoidal shape of the front face 102, the front face 102 typically fills the space between the straight legs 350 and the ladder top 104 and the first step 106 of ladder 346 as well as the space between the angled legs 352 and the ladder top 104 and the first step 106 of ladder 348. This is possible partly due to the substantially "C" shaped cross section found in some ladder legs. The lateral sides 218 of the front face 102 can extend within the "C" shaped cross section of the ladder. In this way, the portions of the front face 102 that extend past the space between the straight ladder legs 350 are still contained within the ladder because the portions of the front face 102 that extend are still contained within the open center portion of the substantially "C" shaped cross section. This is shown in greater detail in FIGS. 8 and 9.

In certain ladders 101, the angle at which the legs of a ladder are disposed near the first step 106 and ladder top 104 varies between 90 degrees and 86 degrees. Under embodiments that are fitted for these ladders 101, the lateral sides 218 of the front face 102 are made at a lateral side angle that corresponds to the angle of the ladder legs. In this way, a single design shape of the front face 102 can accommodate many different ladders.

The height of the front face 102 is set to fit within the space between the ladder top 104 and the first step 106. This distance is regulated by several regulatory agencies. Many regulations set the distance between the ladder top 104 and the first step 106 to be no more than twelve inches. Under certain embodiments, the height of the front face 102 is correspondingly designed to fit within this distance.

Figure 4:
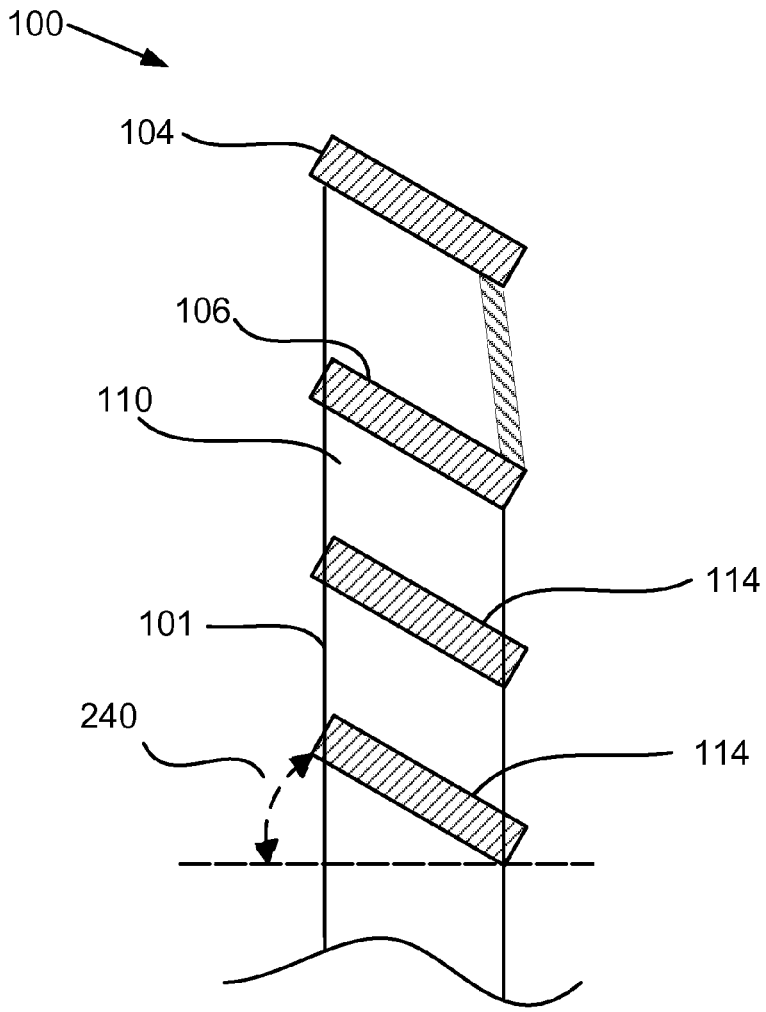
FIG. 4 is a cutaway side view illustrating one embodiment of a ladder step prevention device in accordance with the present invention.
Figure 4:
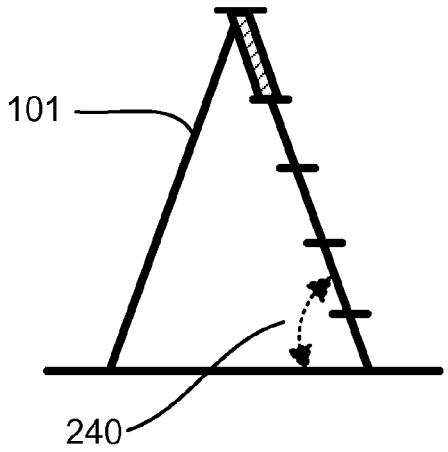

FIG. 2 also shows that the side flaps 216 are attached to the lateral sides 218 of the front face 102. Under one embodiment, the side flaps 216 are constructed at a side flap angle 240 to a bottom edge 236 of the front face 102. This is necessary to accommodate many ladders 101. This is explained in FIG. 4. FIG. 4 shows a cut away view from the middle of a ladder to one of the ladder legs and a cut away view of a folding ladder in the set up position. The top view of FIG. 4 shows a ladder leg in the vertical position. When a ladder is in use, each leg of the ladder creates an angle with the ground. This angle is the same as the side flap angle 240 and is marked as such. When a ladder is stored in a vertical position, the steps are angled at the side flap angle 240 rather than being horizontal. This is shown in the top figure of FIG. 4. This insures that the top surface 114 of each step is close to level with the surface on which the ladder is disposed when the ladder is placed on the ground in the set up position. In order for the ladder step prevention device to fit within the first step 106 and the ladder top 104, the ladder step prevention device 100 is designed to allow space for the side flap angle 240. This is done by disposing the side flaps 216 at the same angle as the angle the ladder 101 makes with the ground, side flap angle 240. Due to regulations, many ladders are angled at a minimum of 75 degrees to the ground when set up. The variation in the actual angle of the ladder to the ground varies but remains close to 80 degrees for many ladders. Due to the similarity in the angle to the ground, or the side flap angle 240, at which many ladders function, the ladder step prevention device 100 fits over the first step 106 of many different ladders 101.

Figure 5:
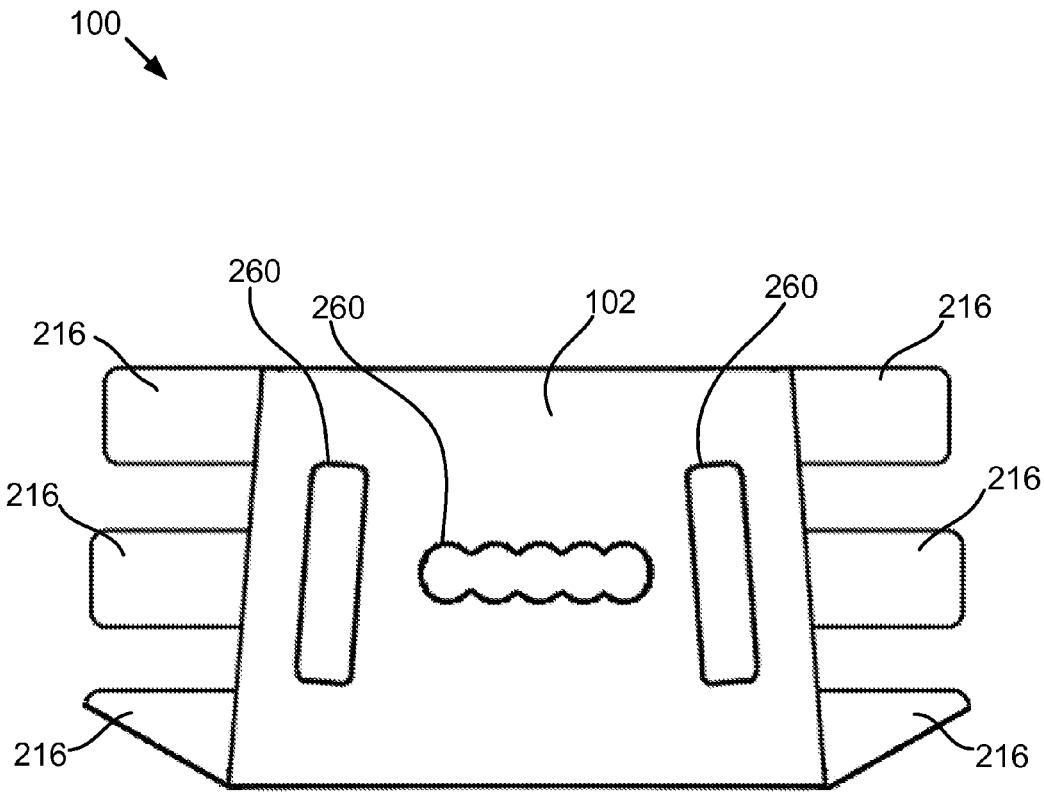
FIG. 5 is a front view illustrating one embodiment of a ladder step prevention device in accordance with the present invention.

Referring to FIG. 5, the side flaps 216 can be shaped in any manner that allows space for the side flap angle 240. The side flaps 216 may be rectangular, semicircular, arched, triangular, or any other shape that allows space for the side flap angle 240. The side flaps 216 may extend the full length of the front face 102 or they may end short of the full length of the front face 102.

Under one embodiment, the side slaps 216 are thicker than the front face 102 in order to give them added strength. Under another embodiment, the side flaps 216 are thinner than the front face 102 in order to make them more flexible.

Under another embodiment, the side flaps 216 are angled to the top edge 242 of the front face 102 in addition to the side flap angle 240 from the bottom edge 236 of the front face 102. This may allow the side flaps 216 to fit more easily in the substantially "C" shaped cross section of the ladder legs.

The embodiment of FIG. 5 contains six side flaps 216. Three side flaps 216 are disposed on each side of the front face 102. Under another embodiment, the side flaps 216 include a plurality of side flaps 216. The plurality of side flaps 216 can be shaped as rectangles, semicircles, arches, triangles, or any other shape. The plurality of side flaps 216 may each be shaped differently under certain embodiments or the plurality of side flaps 216 may be similarly shaped. Under the embodiment of FIG. 2, two side flaps 216 are disposed on opposite sides of the front face 102. Each side flap 216 extends the height of the front face 102.

Figure 6:
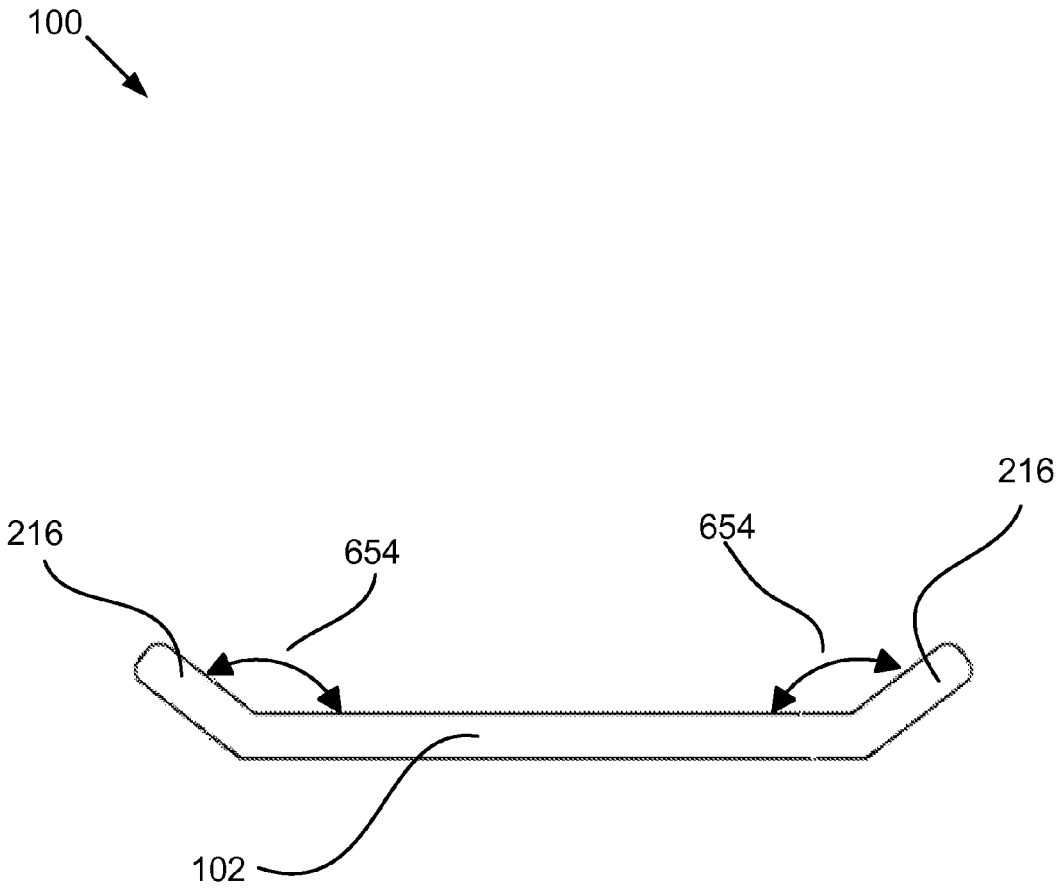
FIG. 6 is a top view illustrating one embodiment of a ladder step prevention device in accordance with the present invention.

Under the embodiment of FIG. 2, the side flaps 216 and the front face 102 are manufactured as a single substantially flat material. The substantially flat material is scored along the lateral side 218 of the front face 102 to allow the user to fold the side flaps 216 at an angle to the front face 102. Under other embodiments, any method may be used to assist the user in folding the side flaps 216 in relation to the front face 102. Under the embodiment of FIG. 6, the side flaps 216 and the front face 102 are manufactured in a manner such that the side flaps 216 are pre-formed at a manufactured spring angle 654 to the front face 102. This can be done using any type of molding, bending or other pre-forming process. The manufactured spring angle 654 between the front face 102 and the side flaps 216 provides a spring force when the ladder step prevention device 100 is secured in the ladder.

Under one embodiment, the ladder step prevention device 100 is constructed of a solid material. Under one embodiment, the ladder step prevention device 100 is constructed of a hard, solid material so that it is sufficiently strong to be grasped by the user if the user needs to be stabilized by grasping an area of the ladder. The hard, solid material may be metal, plastic, fiberglass, lexan, acrylic, carbon fiber, PVC, composite material or any other hard, solid material. Under one embodiment, the ladder step prevention device 100 is constructed of aluminum. Under another embodiment, the ladder step prevention device 100 is constructed of a material that is chemical resistant, UV resistant and weather resistant so that the ladder step prevention device 100 can be left outside.

Under one embodiment, the front face 102 and the side flaps 216 are constructed of the same material. Under another embodiment, the front face 102 is constructed from a different material than the side flaps 216.

Figure 7:
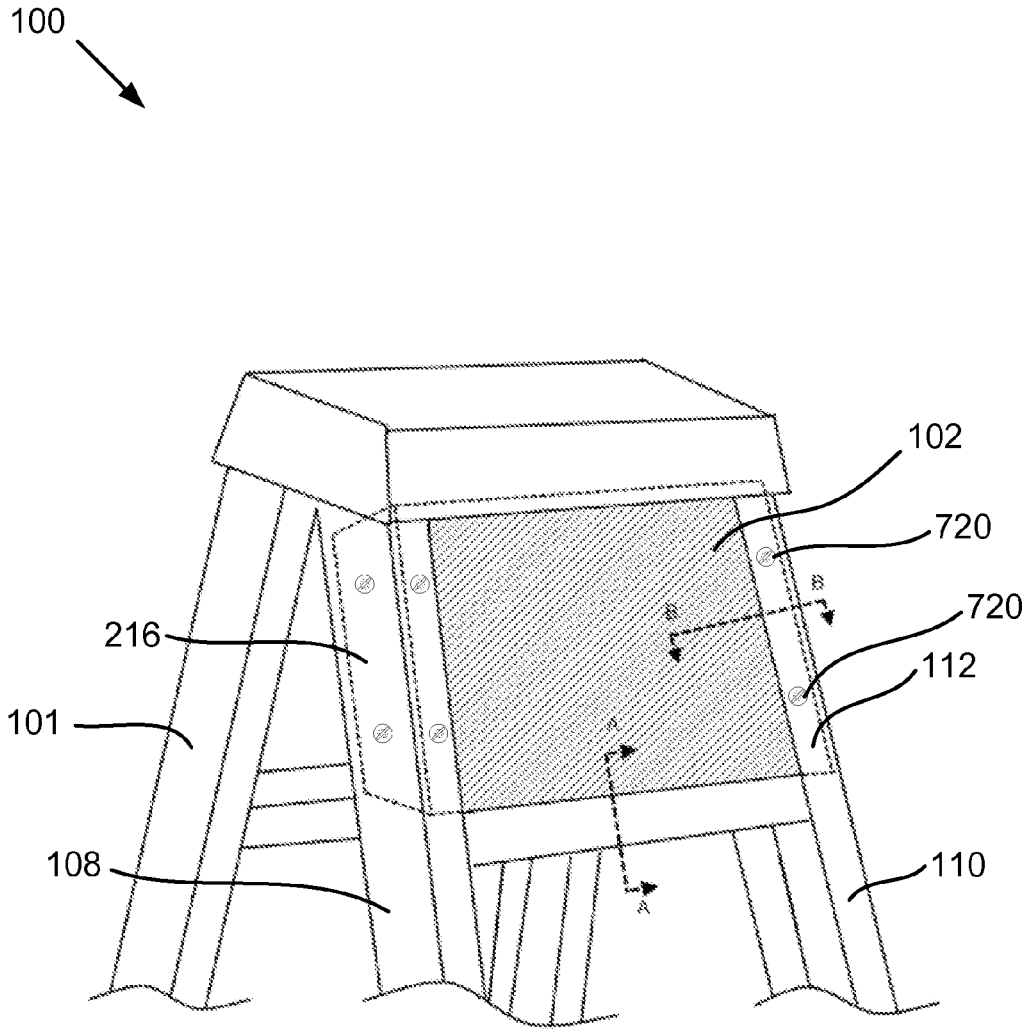
FIG. 7 is a perspective view illustrating one embodiment of a ladder step prevention device in accordance with the present invention.

FIG. 7 shows an embodiment of the ladder step prevention device 100 in which the ladder step prevention device 100 is installed in a ladder 101. The front face 102 is substantially flush with the face 112 of the ladder. Under this embodiment, the side flaps 216 are forced backward to create a smaller angle between the side flaps 216 and the front face 102 than the manufactured spring angle 654. The side flaps 216 are forced to a smaller angle by the right leg 110 and left leg 108 of the ladder. Because the side flaps 216 are forced to a smaller angle, there is a spring force that pushes back against the right leg 110 and the left leg 108. Under this embodiment, spring force insures that the side flaps 216 do not remove easily from the ladder 101. Under other embodiment, the spring force holds the side flaps 216 to the ladder 101 while still allowing the user to easily remove the ladder step prevention device 100 from the ladder 101.

Figure 8:
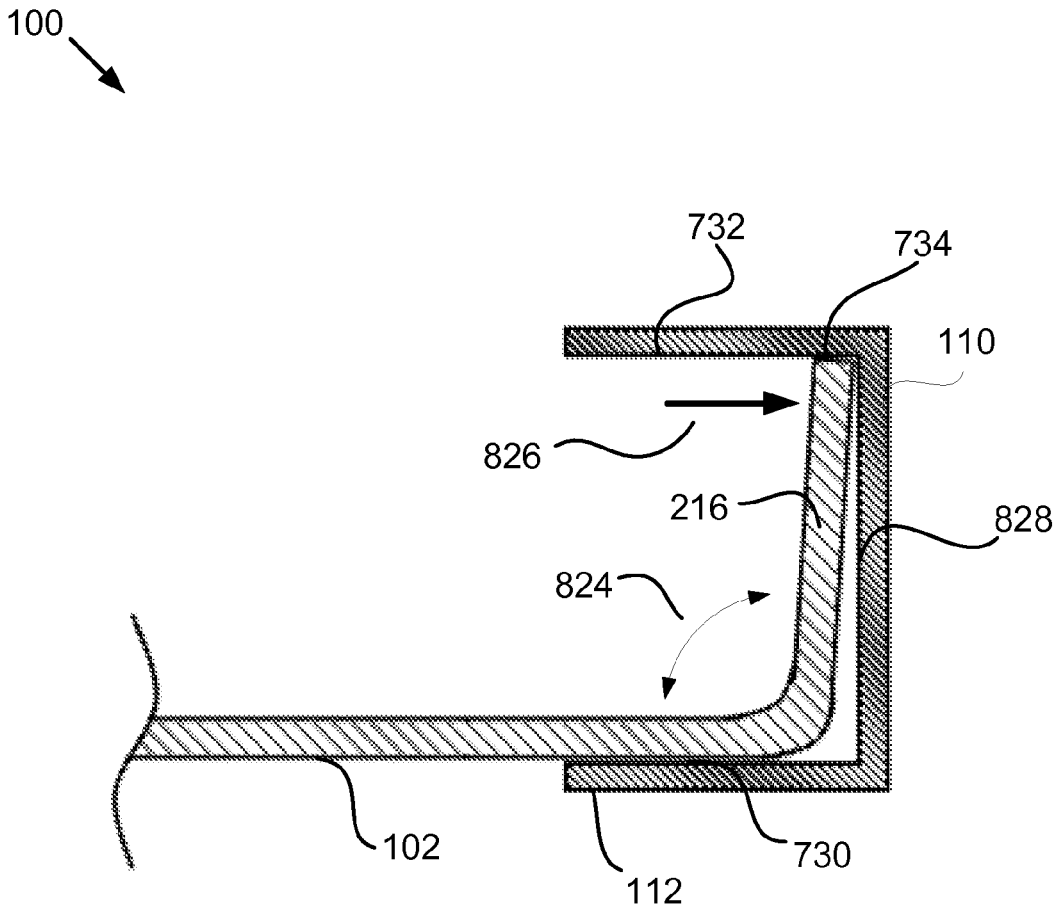
FIG. 8 is a cutaway top view (B-B on FIG. 7) illustrating one embodiment of a ladder step prevention device in accordance with the present invention.

FIG. 8 shows a top view of the "C" shaped cross section of the right leg 110 taken from view B-B from FIG. 7. The movement of the side flap 216 from the manufactured spring angle 654 to the smaller angle 824 creates a force in a spring force direction 826. This force pushes the side flap 216 in the spring force direction 826 onto the open center portion 828 of the "C" shaped cross section. The spring force also insures that the side flap 216 does not easily remove from the right leg 110 of the ladder. The spring force can also makes it difficult for a user to remove the ladder step prevention device 100 from a ladder in which the ladder step prevention device 100 has been installed.

The side flaps 216 have a horizontal length fitting within the open center portion 828 of the "C" shape of the right leg 110. Under one embodiment, the horizontal length of the side flaps 216 extends from a front edge 730 of the "C" shape of the right leg to a rear edge 732 of the "C" shape of the right leg 110. Under other embodiments, the horizontal length of the side flaps 216 is less than the full distance from the front edge 730 of the "C" shape of the right leg 110 to the rear edge 732 of the "C" shape of the right leg 110.

Under one embodiment, at least one portion of a lateral end 734 of the side flap 216 contacts the rear edge 732 of the "C" shape of the right leg 110 when the side flaps 716 are placed in the "C" shape of the ladder leg. In embodiments in which the "C" shape of the right leg 110 is substantially the same length as the horizontal length of the side flaps 216, the side flap 216 contact most of the open center portion 828 of the right leg 110. In embodiments in which the "C" shape of the right leg 110 is larger than the horizontal length of the side flaps 216, the spring force exerted by the side flaps 216 will typically insure that the ladder step prevention device 100 is still held in place. Under certain embodiments, the side flap 216 contacts the open center portion 828 in at least one area due to the spring force in the spring for direction 826.

Under one embodiment, the lateral end 734 of the side flaps 216, opposite the front face 102, contacts the rear edge 732 of the "C" shaped cross section so that the side flaps 216 force the front face 102 substantially onto the front edge 730 of the substantially "C" shaped cross section. The contact between the lateral end 734 of the side flaps 216 and the rear edge 732, in combination with the spring force in the spring force direction 826 make the front face 102 substantially flush with the face 112 of the ladder.

Figure 9:
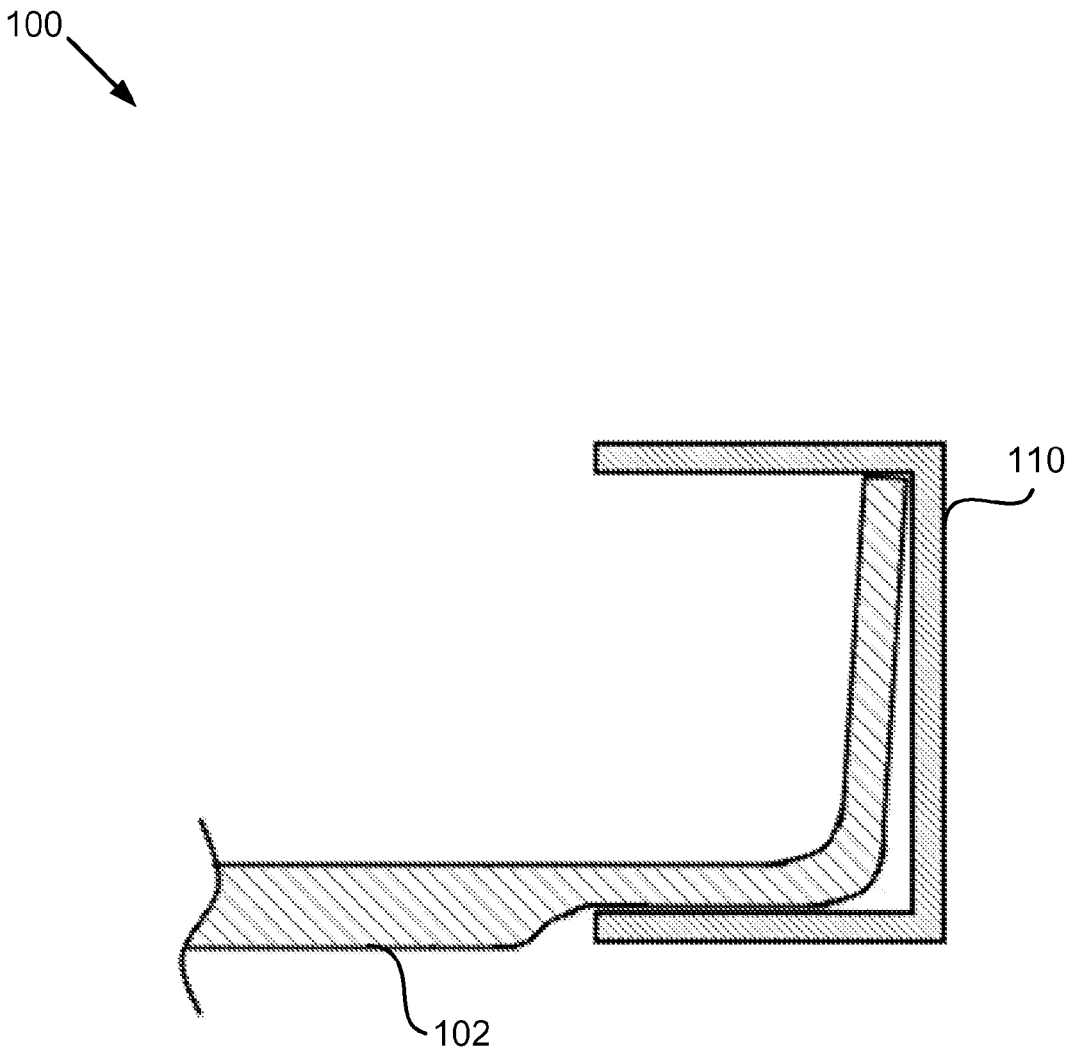
FIG. 9 is a cutaway top view (B-B on FIG. 7) on illustrating one embodiment of a ladder step prevention device in accordance with the present invention.

FIG. 9 shows another embodiment of the top view of the substantially "C" shaped cross section of the right leg 110 taken from view B-B from FIG. 7. Under this embodiment, the front face 102 is expanded outwardly at a point beyond the substantially "C" shaped cross section of the right leg 110. This further ensures that the front face 102 is substantially flush with the face of the ladder.

Figure 10:
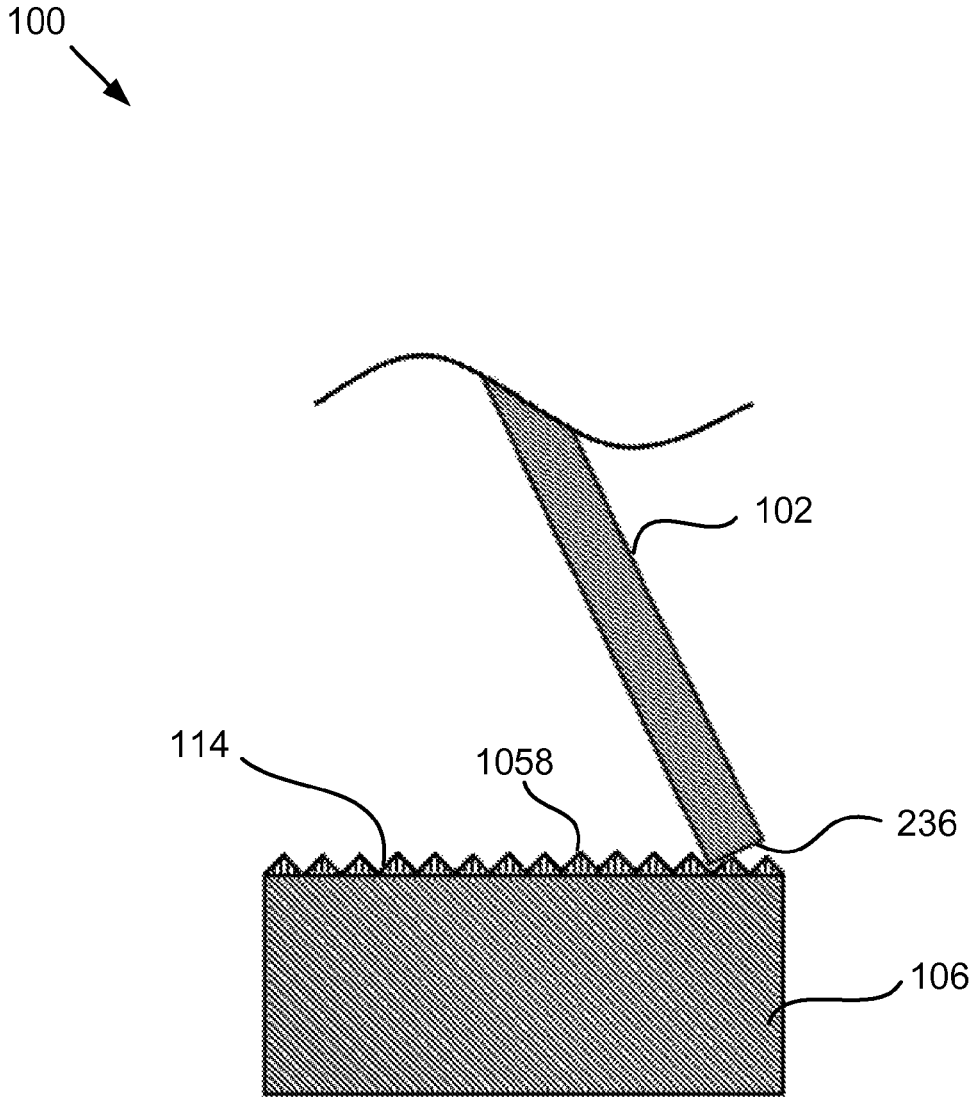
FIG. 10 is a cutaway side view (A-A on FIG. 7) illustrating one embodiment of a ladder step prevention device in accordance with the present invention.

FIG. 10 shows a side view of a bottom edge 236 of the front face 102 taken from view A-A from FIG. 7. The bottom edge 236 is in contact with the top surface 114 of a ladder step. Many regulatory agencies require that the top surface 114 of a ladder step contain some type of non-skid surface 1058. The non-skid surface 1058 may comprise non-slip tape, grooves, a knurled surface, a corrugated surface, a dimpled surface or any other non-slip surface treatment. When the ladder step prevention device 100 is positioned over the top surface 114 of the first step 106, the bottom edge 236 contacts the non-skid surface 1058 disposed on the top surface 114 of the first step 106. This contact adds stability to the ladder step prevention device 100 in addition to that provided by the spring force of the side flaps 216. Under other embodiments, the bottom edge 236 may be positioned with a small space between the bottom edge 236 and the first step 106.

Figure 11:
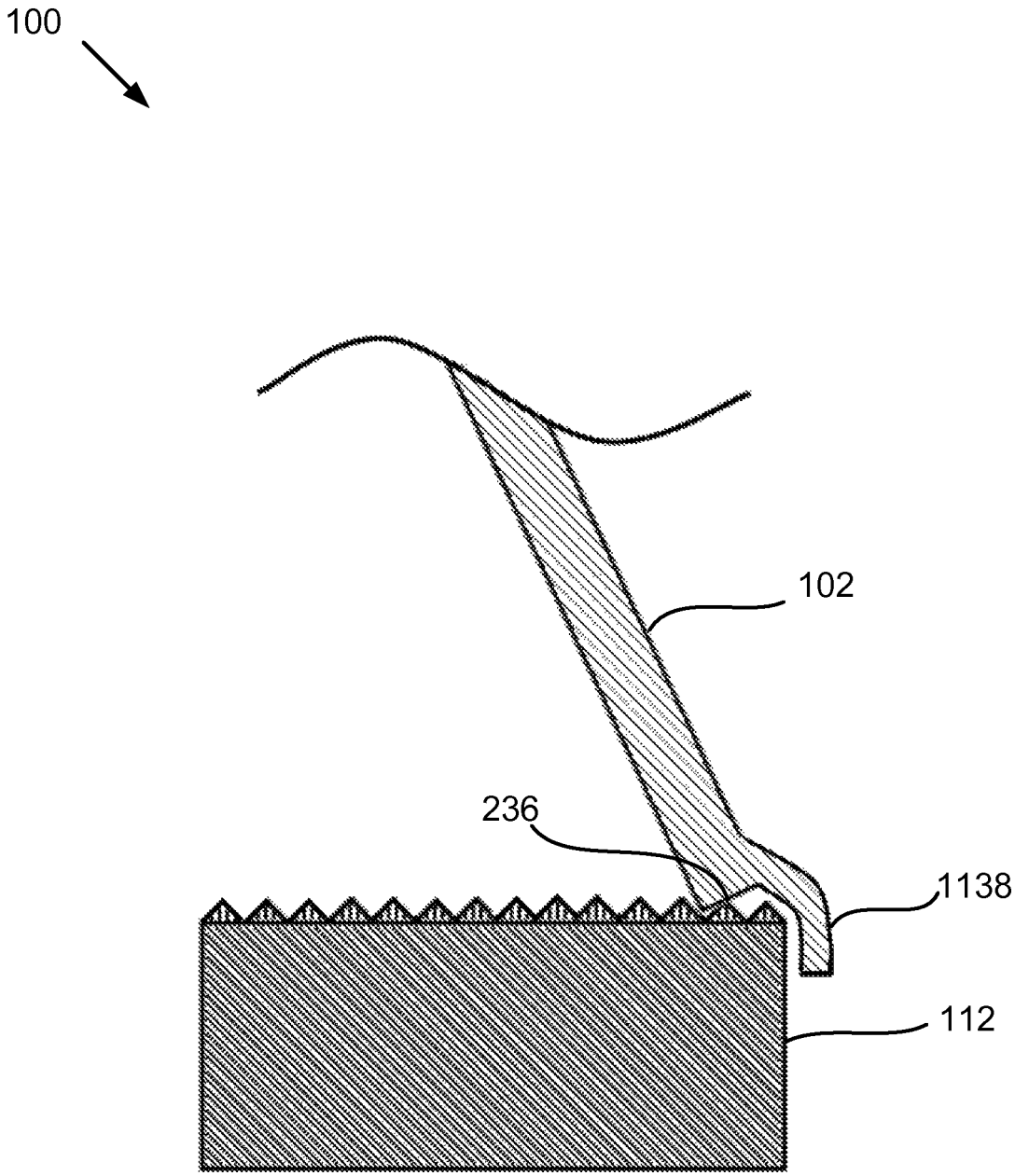
FIG. 11 is a cutaway side view (A-A on FIG. 7) illustrating one embodiment of a ladder step prevention device in accordance with the present invention.

Under the embodiment of FIG. 11, the front face 102 further comprises an extension 1138 disposed over the ladder step. The extension 1138 further insures that the ladder step prevention device 100 is secured in the ladder 101 by further preventing the bottom edge 236 of the front face 102 from slipping. The extension 1138 also further insures that the front face 102 is substantially flush with the face 112 of the ladder. In many instances, this prevents the possibility that a user could step on a portion of the step that protrudes from under the front face 102.

Referring to the embodiment of FIG. 7, the ladder step prevention device 100 is further secured to the ladder through the use of bolts 720. The bolts 720 extend through openings in the left leg 108 of the ladder 101 and the right leg 110 of the ladder 101 and through corresponding openings in the front face 102 and side flaps 216 of the ladder step prevention device 100. Under the embodiment of FIG. 2, openings 222 are disposed in the side flaps 216. Under another embodiment, openings are disposed through the front face 102. Under another embodiment, openings are disposed through the front face 102 and the side flaps 216. Under other embodiment, a securing component other than bolts can be used which include screws, nuts, locks, locking screws, coder keys, rods, pins, cotter pins, soldering, welding, riveting, or any other securing method. This may be desired to insure that the ladder step prevention device 100 is not removed from the ladder without needing to remove the securing component. Under another embodiment, the securing component is permanently attached to the ladder and the side flaps 216. This may be done during the manufacturing process of the ladder or may be done by the user after buying the ladder. Under another embodiment, the securing component is temporarily attached to the ladder and the side flaps 216 so that the securing component and the ladder step prevention device 100 can be removed.

Under another embodiment, a tamper evident locking mechanism is disposed on the ladder step prevention device 100 to inform the user if the ladder step prevention device has been removed. Under one embodiment, the tamper evident locking mechanism includes a plastic tie disposed through an opening in the side flap 216 and disposed through the ladder 101. Because the plastic tie is disposed through the ladder 101 and the opening in the side flap 216, the ladder step prevention device 100 cannot be removed without removing the plastic tie. The plastic tie is designed so that it cannot be replaced once it is removed from the ladder step prevention device 100. In this manner, a user can know if the ladder step prevention device 100 has been removed from a ladder by checking the tamper evident locking mechanism.

Under another embodiment, a bolt containing a locking adhesive is used to secure the ladder step prevention device 100 to the ladder. In this manner, the bolt is difficult to remove and leaves an adhesive residue that prevents the user from replacing the ladder step prevention device 100 once the device has been removed.

Under another embodiment, the openings 222 disposed in the side flaps 216 and front face 102 and the corresponding openings disposed in the ladder further contain threaded sockets. The threaded sockets correspond to bolts or screws that are used to secure the ladder step prevention device 100 to the ladder 101.

Under another embodiment, the front face 102 further comprises one or more hand holes 260 disposed in the front face 102. Under the embodiment of FIG. 2, the hand holes 260 include two rectangular openings in the front face 102. Under the embodiment of FIG. 5, the hand holes 260 comprise two rectangular openings and one opening designed to ergonomically fit with the fingers of a user. The two rectangular openings are disposed in a vertical direction and the one opening designed to ergonomically fit with the fingers of a user is disposed in a horizontal direction. When the ladder 101 is carried in a horizontal orientation, the vertical openings may be used to carry one end of the ladder. In the case of a long ladder, the ladder may be carried by two users. The hand holes 260 are used by one user while the other user carries an opposite end of the ladder. When the ladder is carried in a vertical orientation, the horizontal opening can be used to carry the ladder. Under one embodiment, the hand holes 260 can also be used to install the ladder step prevention device.

The user can grasp the hand holes 260 from in front of the ladder to pull the ladder step prevention device 100 into place.

The hand holes 260 can be square shaped, oval shaped, circular shaped, oval shaped with peaked points to conform to the user's hand or any other shape that fit on the front face 102 of the ladder step prevention device 100. The hand holes 260 can be disposed in a center of the front face 102 or any other area of the front face 102. The hand holes 260 can be vertically disposed, horizontally disposed, both horizontally disposed and vertically disposed, or disposed at an angle. This allows the user to comfortably carry the ladder in a multiplicity of orientations.

Under another embodiment, the hand holes 260 protrude from the front face 102 of the ladder step prevention device 100. The hand holes 260 may be in the shape of a protruding handle. The handle may be annular or may be in the shape of a cavity that has one opening designed to receive the fingers of the user.

Under another embodiment, the hand holes 260 have rounded edges to make the hand holes 260 more comfortable for the user to grasp.

Under one embodiment, the ladder step prevention device 100 is manufactured as part of the ladder. A ladder manufacturer may wish to manufacture the ladder step prevention device 100 as part of a ladder 101 to increase the step prevention of the ladder 101. A ladder manufacturer may place a logo or symbol representing the manufacturer on the front face 102 of the ladder step prevention device 100. Under another embodiment, the ladder step prevention device 100 is installed by the user after the ladder 101 is purchased. The ladder step prevention device 100 may be permanently attached to the ladder 101 or may be removable by the user.

Referring to the embodiment of FIG. 4, the ladder step prevention device 100 does not add size to the ladder 101 when the ladder 101 is stored in an upright position. The ladder step prevention device 100 does not affect a folding ladder's ability to fold for storage. The ladder step prevention device 100 is designed to be usable on a wide variety of ladder types and configurations. The ladder step prevention 100 device can be installed in a normal folding ladder, a folding ladder that does not contain a ladder cap, a ladder that does not come to hinge at the top, a straight ladder, or many other types and manufactures of ladders.

Figure 12:
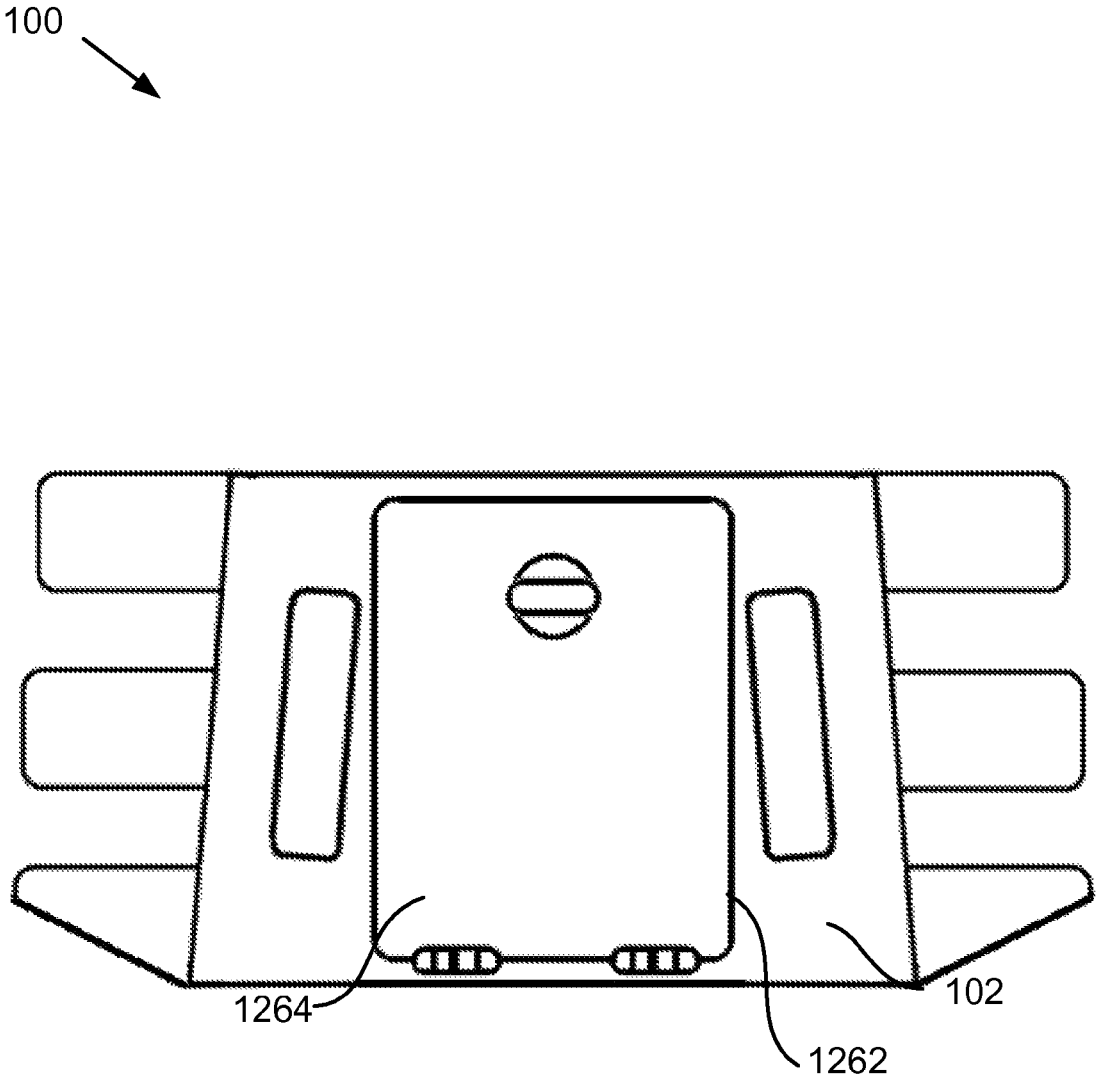
FIG. 12 is a front view illustrating one embodiment of a ladder step prevention device in accordance with the present invention.

Under the embodiment of FIG. 12, the ladder step prevention device 100 includes a compartment 1262 situated behind the front face 102. The compartment 1262 contains an access panel 1264 which is disposed on the front face 102. The access panel 1264 prevents the compartment 1262 from being used as a step. Under another embodiment, the access panel 1264 is not centered on the front face 102 but is toward a lateral side 218 of the front face 102. Under another embodiment, the access panel 1264 covers substantially all of the front face 102. The access panel may be configured in a plurality of manners in different embodiments.

Figure 13:
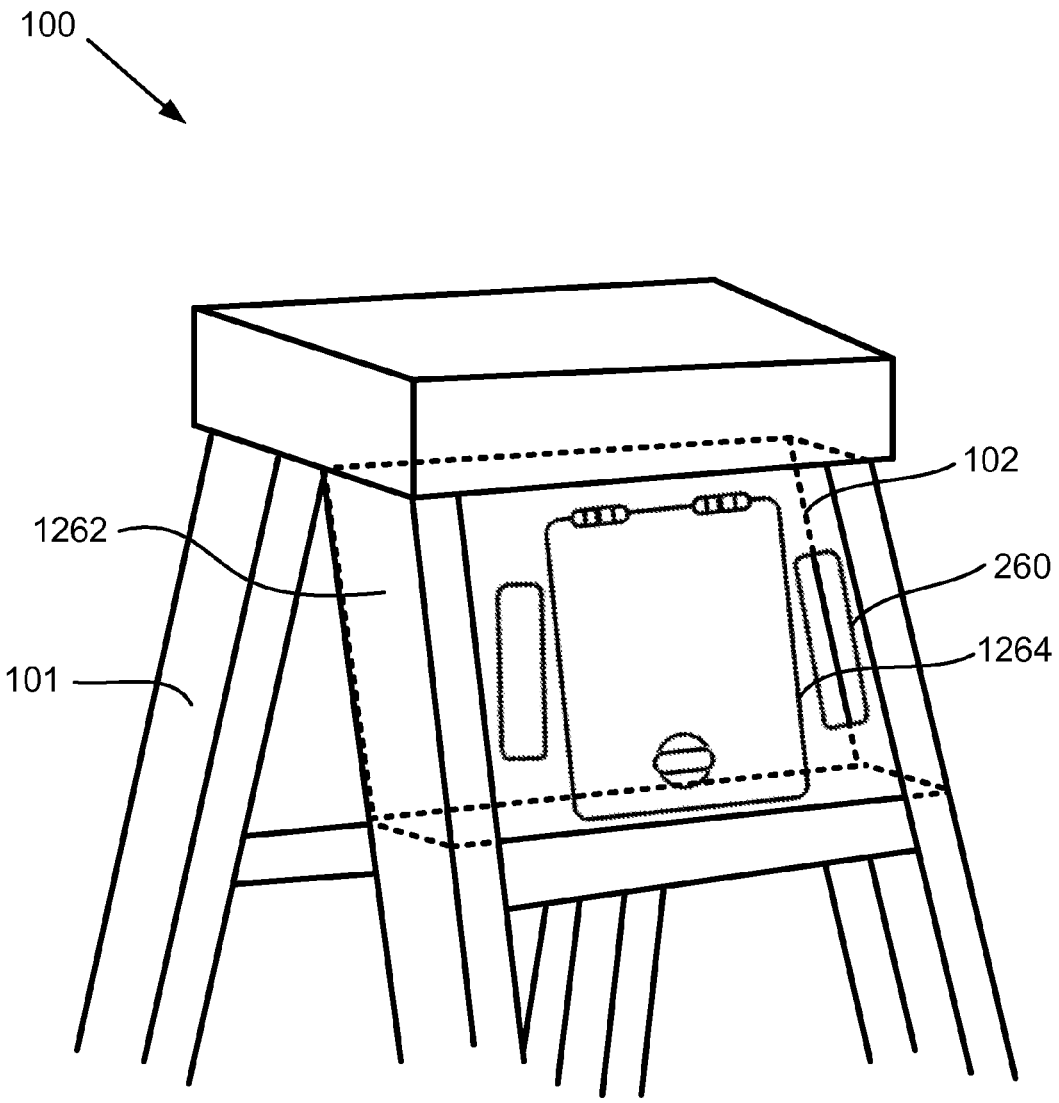
FIG. 13 is a perspective view illustrating one embodiment of a ladder step prevention device in accordance with the present invention.

Under the embodiment of FIG. 13, the compartment 1262 extends behind the front face 102 into an area of the ladder 101. The ladder 101 can still be folded and stored with the compartment 1262 disposed therein. The access panel 1264 may be hinged at the top, sides or bottom. Under one embodiment, the access panel 1264 is not hinged but is held to the front face 102 by a locking mechanism. The locking mechanism may be a latch, a lock and key, or any other locking mechanism that can be disposed on the access panel 1264.

In this embodiment, the hand holes 260 are disposed through the front face 102 into the compartment 1262. Under one embodiment, the compartment 1262 is water proof and protects the contents of the compartment. The compartment 1262 may be used to hold work tools, documents, food, paint, paint brushes or any other object or group of objects that a user wishes to place in the compartment.

Figure 14:
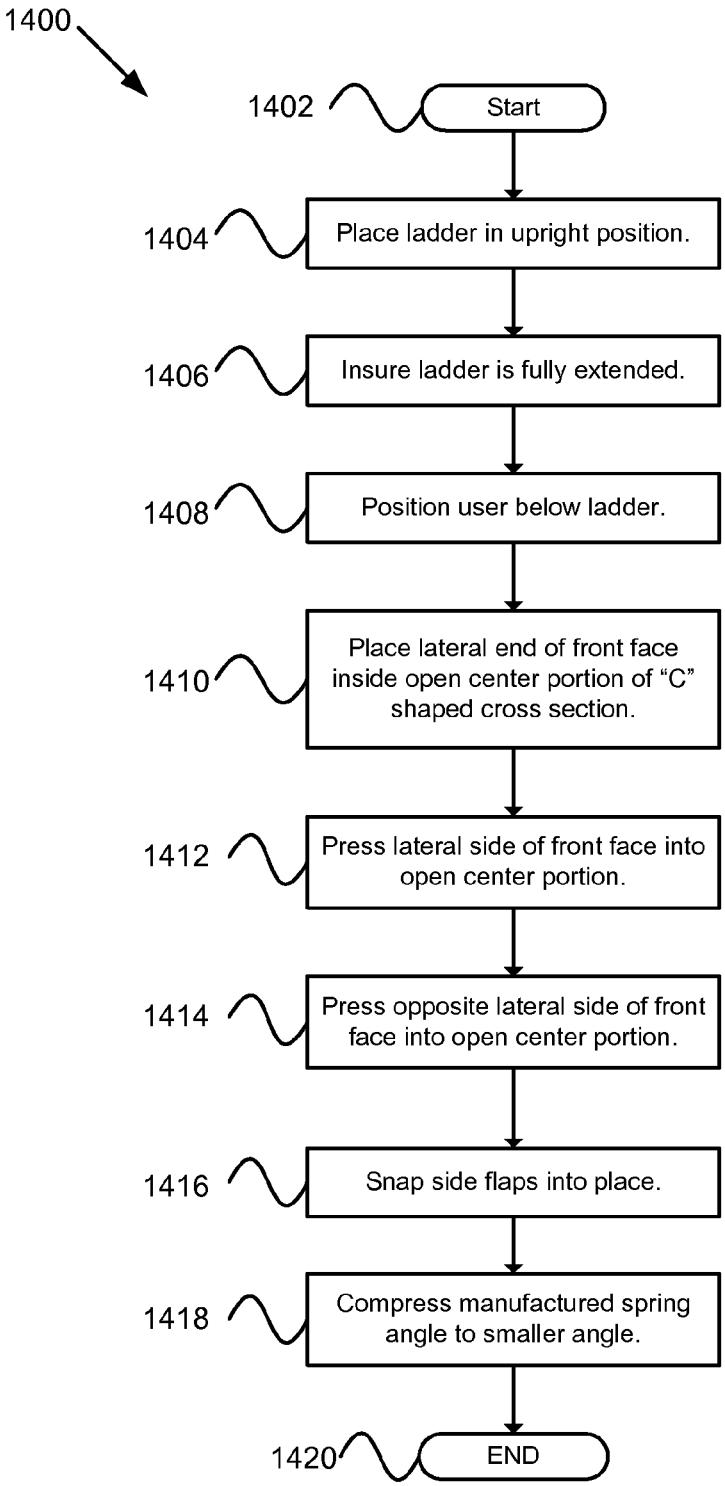
FIG. 14 is a schematic block diagram illustrating one embodiment of a method of protecting the user of a ladder.

FIG. 14 is a schematic flow chart diagram illustrating one embodiment of a method for preventing a ladder user from standing on the first step 106 of a ladder 101 below the top of the ladder 101. In one embodiment, the method 1400 starts 1402 and the user places 1404 the ladder 101 in an upright position. The user insures 1406 that the ladder 101 is fully extended in the case of a folding ladder. In the case of a non-folding ladder, the user insures 1406 that the ladder 101 is angled according to regulation. The user moves 1408 to a position inside and underneath that ladder. The user places 1410 a lateral side 218 of the front face 102 inside the open center portion 828 of the substantially "C" shaped cross section of the ladder leg. The user presses 1412 the lateral side 218 of the front face 102 into the open center portion 828 of the substantially "C" shaped cross section of the ladder leg. The user then presses 1414 the opposite lateral side 218 of the front face 102 into the open center portion 828 of the substantially "C" shaped cross section of the ladder leg. The side flaps 216 flex 1416 against both legs of the ladder and snap 1418 into place as the side flaps 216 pass the rear edge 732 of the substantially "C" shaped cross section of the ladder leg. The manufactured spring angle 654 compresses 1420 into the smaller angle 824 due to an inward force exerted by the ladder legs. This insures that the ladder step prevention device 100 cannot be easily removed from the ladder. The method 1400 then ends 1418.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to limit access to a ladder step, the apparatus comprising:

a front face that extends between a bottom of a ladder top and a top surface of a first step below the ladder top, wherein the solid front face is substantially flush with and substantially fills a planar area, the planar area defined by front surfaces of the ladder top of a ladder, the first step below the ladder top of the ladder, a left leg of the ladder, and a right leg of the ladder, wherein the front face is substantially solid to prevent a user from stepping on the first step, wherein the left leg and right leg of the ladder each comprise a substantially rectangular "C" shaped cross section forming an open channel wherein the open channel of the left leg faces the open channel of the right leg; and a first side flap and a second side flap ("side flaps") integrally connected to opposing lateral sides of the front face and disposed at an angle to the front face, wherein the angle of the side flaps creates a spring force when resiliently inserted into the channels of the legs of the ladder by pressing in an outward direction, wherein the side flaps have a horizontal depth that fits within the channels and the side flaps have back lateral edges, opposite the front face, that contact a back surface of the channels and position the front face substantially flush with said planar area.

2. The apparatus of claim 1, wherein the side flaps extend the height of the front face.

3. The apparatus of claim 1, further comprising one or more openings disposed in one or more of the side flaps and the front face.

4. The apparatus of claim 3, wherein the one or more openings permit attachment of the apparatus to the ladder.

5. The apparatus of claim 4, wherein the one or more openings are aligned with corresponding openings in the ladder and a securing means is disposed between the one or more openings and the openings in the ladder.

6. The apparatus of claim 5, wherein the securing means consist of one or more of screw, nut, bolt, lock, locking screw, cotter key, rod and pin.

7. The apparatus of claim 1, further comprising a tamper evident locking mechanism.

8. The apparatus of claim 1, further comprising a bottom edge of the side flaps that is disposed at an angle to a bottom edge of the front face, the angle allowing the apparatus to fit over a top surface of the first step.

9. The apparatus of claim 1, wherein the front face is substantially trapezoidal such that the front face will substantially fill the area between the ladder top and the first step for ladders with legs that angle inward from bottom to top.

10. The apparatus of claim 1, further comprising one or more hand holes disposed in the front face.

11. The apparatus of claim 1, wherein the front face and side flaps are constructed from one or more of plastic, fiberglass, lexan, acrylic, carbon fiber, PVC and sheet metal.

12. The apparatus of claim 1, wherein the front face and side flaps are manufactured as a single substantially flat material, the material being scored to allow a user to bend the side flaps at an angle to the front face.

13. The apparatus of claim 1, wherein the front face and side flaps are manufactured with the side flaps pre-formed at an angle to the front face.

14. A system to limit access to a ladder step, the system comprising:

a ladder with a ladder top and first step below the ladder top; and an apparatus to limit access to a ladder step, the apparatus comprising:

a solid front face that extends between a bottom of the ladder top and a top surface of the first step, wherein the solid front face is substantially flush with and substantially fills a planar area, the planar area defined by front surfaces of the ladder top of a ladder, the first step below the ladder top of the ladder, a left leg of the ladder, and a right leg of the ladder, wherein the front face is substantially solid to prevent a user from stepping on the first step, wherein the left leg and right leg of the ladder each comprise a substantially rectangular "C" shaped cross section forming an open channel, wherein the open channel of the left leg faces the open channel of the right leg; and a first side flap and a second side flap ("side flaps") integrally connected to opposing lateral sides of the front face and disposed at an angle to the front face, wherein the angle of the side flaps creates a spring force when resiliently inserted into the channels of the legs of the ladder by pressing in an outward direction, wherein the side flaps have a horizontal depth that fits within the channels and the side flaps have back lateral edges, opposite the front face, that contact a back surface of the channels and position the front face substantially flush with said planar area.

15. The system of claim 14, further comprising one or more openings disposed in one or more of the side flaps and the front face.

16. A method for preventing access to a ladder step, the method comprising:

placing a first side flap that is disposed on a lateral end of a front face inside an open center portion of a first leg of a ladder below a top of the ladder and above a first step of the ladder, the first step below the top of the ladder without any intervening steps, the front face comprising the first side flap and a second side flap, the first side flap disposed on a lateral side opposite the second side flap, the side flaps being integrally connected with the front face, the first side flap and the second side flap ("side flaps") being disposed on the lateral sides of the front face at an angle to the front face, the first leg of the ladder having a substantially "C" shaped cross section forming a channel and an open center portion of the "C" shape of the first leg of the ladder is facing the center of the ladder;

pressing the first side flap of the front face into the open center portion of the substantially "C" shaped cross section of the first leg of the ladder;

pressing the second side flap of the front face into the open center portion of the substantially "C" shaped cross section of a second leg of the ladder opposite the first leg of the ladder;

allowing the first and second side flaps to flex against the open center portion of the "C" shaped cross section of both legs of the ladder, the angle of the first and second side flaps creating a spring force when inserted in the ladder by pressing in an outward direction on the open center portion of the "C" shaped cross sections of the first leg and of the second leg, the first and second side flaps having a horizontal length fitting within the open center portion of the "C" shape of the ladder legs, a lateral edge of the first and second side flaps, opposite the front face, contacting a back edge of each "C" shaped cross section of the legs so that the first and second side flaps position the front face substantially onto a front edge of the "C" shaped cross section, the spring force positioning the front face so that it is substantially flush with and substantially fills a face of the ladder, the back edge of the "C" shaped cross section interior to the open center portion of the "C" shape and distal to the front edge of the "C" shaped cross section.

* * * * *